United States Patent [19]

Mehlan et al.

[11] 4,441,628

[45] Apr. 10, 1984

[54] TRAP DOOR CHUTE FOR VENDING MACHINES

[75] Inventors: Bernd Mehlan; Josef Bayer, both of Herrieden, Fed. Rep. of Germany

[73] Assignee: Sielaff GmbH & Co., Fed. Rep. of Germany

[21] Appl. No.: 306,426

[22] Filed: Sep. 28, 1981

[30] Foreign Application Priority Data

Oct. 24, 1980 [DE] Fed. Rep. of Germany ..... 3040089

[51] Int. Cl.[3] ..... G07F 11/06

[52] U.S. Cl. ..... 221/90; 221/110

[58] Field of Search ..... 221/90, 89, 110, 124, 221/126

[56] References Cited

U.S. PATENT DOCUMENTS

| | | | |
|---|---|---|---|
| 1,916,530 | 7/1933 | Richardson | 221/90 |
| 2,652,304 | 9/1953 | Gabrielsen | 221/90 |
| 3,674,173 | 7/1972 | Scarnecchia et al. | 221/6 |
| 3,685,689 | 8/1972 | Borner et al. | 221/90 |
| 3,820,633 | 6/1974 | Thorp, Jr. | 187/95 |
| 3,891,062 | 6/1975 | Geneste | 187/95 |

FOREIGN PATENT DOCUMENTS

| | | | |
|---|---|---|---|
| 820 | 1/1900 | Austria . | |
| 113307 | 7/1899 | Fed. Rep. of Germany . | |
| 1907824 | 9/1970 | Fed. Rep. of Germany | 221/90 |
| 2043021 | 3/1972 | Fed. Rep. of Germany . | |

*Primary Examiner*—Joseph J. Rolla
*Assistant Examiner*—Kenneth Noland
*Attorney, Agent, or Firm*—McGlew and Tuttle

[57] ABSTRACT

In a trap door chute for vending machines, doors are pivotably mounted to sidewalls of the machine, in a certain trap door chute division. Each door supports itself in its merchandise storing position by a finger on an electric detention member. Along one chute wall extends at least one vertical track, along which a carriage with a cam for the deflection of the detention member is movably guided. A lifting bar extends parallel to the track and has a row of teeth whose spacing corresponds to the smallest trap door chute division. The carriage supports itself on the row of teeth via a stepping pawl. A stop is provided on the carriage, with which it rests on one of the detention members. The detention members are tines of a rake made of a spring material.

14 Claims, 2 Drawing Figures

TRAP DOOR CHUTE FOR VENDING MACHINES

FIELD AND BACKGROUND OF THE INVENTION

The present invention relates to a trap door chute for vending machines in which doors are hinged on chute walls in a certain trap door chute division and each door supports itself in its merchandise storing position by a finger on an elastic detention member. At least one vertical track extends along one chute wall, along which a carriage is movably guided, the carriage having a cam to deflect the detention member.

Additional details can be found in two copending applications entitled MECHANICAL VENDING MACHINE (filed Sept. 30, 1981, with Ser. No. 307,293) and PRICE SETTING MECHANISM FOR A VENDING MACHINE (filed Sept. 28, 1981, with Ser. No. 306,427), which are, both now allowed. These applications are related disclosures to the applicants' present invention.

Such a trap door chute is described in German Pat. No. 113,307. It is advantageous, in this trap door chute, that in order to lower the flaps they do not have to be moved against horizontally positioned springs because they interfere with the smooth and easy operation of the trap door chute and represent considerable costs. It is of disadvantage in German Pat. No. 113,307 that an energy store must be provided here to drive the carriage and that the detention members are designed as individual members.

In Austrian Pat. No. 820 a trap door chute is shown in which the trap doors are controlled by means of a stepwise unwinding flat coil spring. In one embodiment, the trap doors are provided, in the area of their bearing points, with a bevel through which the doors are kept in their merchandise storing position. While this permits their simple resetting, the arrangement is mechanically unsatisfactory because the doors only support each other by their longer lever arm. In another case, a separate, two-part detention member is provided opposite each of the bearing pins.

In Austrian Pat. No. 298 130 a trap door chute is described in which the doors are individually horizontally spring-mounted. By means of a rotatable actuating bar extending over the trap door chute height, the doors can be tripped successively in that a cam of the actuating bar moves one door each horizontally so that its finger disengages from the detention member. The actuating bar cams assigned to the individual doors are mutually spaced at distances, increasing from the bottom to the top. It is advantageous here that the more compartments that must be served, the longer the stroke of the bar will become, thus easily assuming heights not available in the usual vending machines. It is costly to mount each door to be horizontally movable on a shaft with two springs. Beyond this, resetting the doors is also complicated.

Trap door chutes in which an upward travelling carriage is provded to trip the doors, but where the doors must be moved horizontally against a spring force are also described in U.S. Pat. Nos. 1,916,530 and 2,623,804.

SUMMARY OF THE INVENTION

It is an object of the invention to provide a trap door chute of the type described above, in which the doors need not be moved sideways and the detention members as well as the carriage drive are of simple design.

According to the invention, the above mentioned problem is solved in that a lifting bar with a row of teeth, the pitch or spacing of which corresponds to the smallest trap door chute division, runs parallel to the track. The carriage is supported by the row of teeth via a stepping pawl and a stop is provided on the carriage by means of which it rests on one of the detention members. The detention members are tines of a rake made of a spring material.

Thus, upon each actuation of the trap door chute, the lifting bar is raised by one trap door chute division, taking along, via the stepping pawl, the carriage whose cam always trips the next higher trap door. The carriage stop assures it resting, in a raised position, on one of the detention members until it is actuated again. Additional blocking means for the carriage are thus obviated. All detention members are formed by one single component, namely a rake consisting of spring steel, for example, so that the detention members can function individually and yet their manufacture and assembly are simple.

To be able to convert the trap door chute to different trap door chute divisions of equal size, i.e. to different compartment heights, the lifting bar stroke occurring upon an actuation is adjustable. The stroke length matches the compartment height, but it is independent of the number of compartments.

In an advantageous embodiment of the invention there are provided on the trap doors, near their bearing points, reset bevels which project into the path of motion of a reset member disposed on the carriage when the trap doors are tripped. For the return of the carriage a coupling lever is mounted to it, which disengages the stepping pawl from the row of teeth and pushes the reset member against the reset bevels.

What this achieves is that the carriage can be returned and the doors reset into their storing position, both in one single motion.

Accordingly another object of the invention is to provide a trap door chute for a vending machine comprising, a plurality of spaced doors pivotally hinged at one end to a chute wall of the machine, each door having a finger extending from an opposite end thereof, a rake having a plurality of tines made of spring material each forming an elastic detention member in the machine for supporting each of said fingers in a storing position, at least one vertical track in the machine extending substantially across a range of said spaced doors, a carriage mounted for movement along said track, a cam on said carriage for deflecting each deflection member as the carriage moves along said track to release each supported finger and allow each respective door to fall into a non-supported position, a lifting bar extending substantially parallel to said track having a plurality of teeth with a spacing corresponding to a smaller spacing between said doors, a pawl on said carriage engaged with one of said teeth to support said carriage in a position before said cam deflects a next higher detention member, and a stop on said carriage for supporting said carriage on a detention member below said next higher detention member.

Another object of the invention is to provide an actuator connected to said lifting bar for lifting said lifting bar by a distance equal to the smallest spacing between said doors to cause said cam to deflect the next higher deflection member and bring said pawl into a position to engage a next higher tooth of said lifting bar.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF PREFERRED EMBODIMENT

Figure 1:
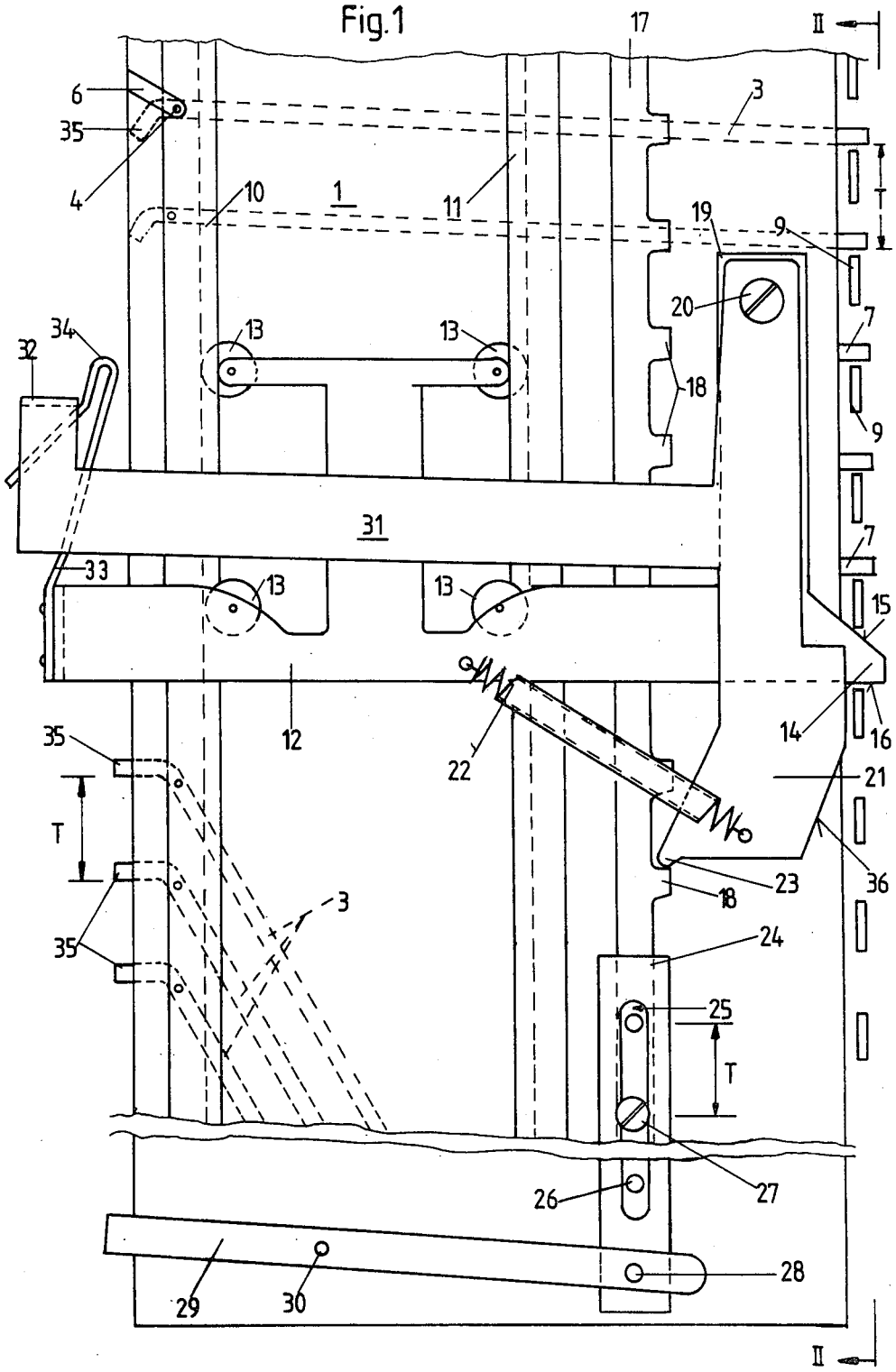
FIG. 1 is a partial side view of a trap door chute according to the invention.
Figure 2:
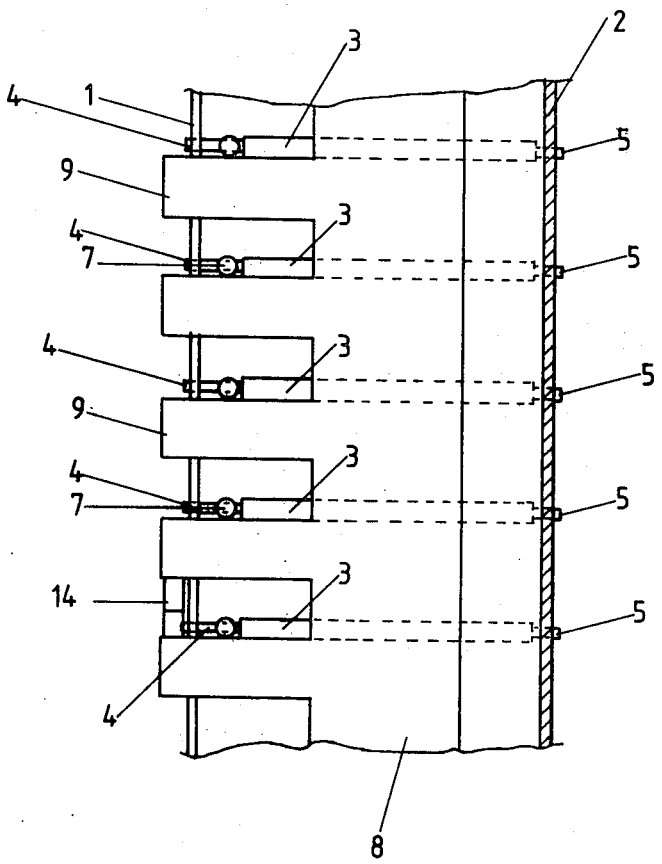
FIG. 2 is a partial rear view of the trap door chute according to FIG. 1 taken along the line II—II.

Turning to the drawings in particular, the inventiin embodied therein in FIGS. 1 and 2 comprises a trap door chute for a vending machine which includes a chute wall 1 and a spaced opposite side wall 2. A plurality of doors 3 are spaced vertically along the vending machine, with one end hinged, at pins 4, to the chute wall 1, and an opposite end supported on elastic detention members, described more fully hereunder.

A multiplicity of doors 3 are mounted at equal distances apart in side walls 1 and 2 of a trap door chute. Each door 3 has two pins 4 and 5 by means of which they are hung in recesses 6 of the sidewalls 1 and 2, and about which they can pivot. On the side opposite the recesses 6, each door 3 has a finger 7 near the sidewall 1.

On the backside (see FIG. 2) of the trap door chute is mounted a rake 8 consisting of spring steel. Tines 9 of the rake 8 form detention members on which the fingers 7 of trap doors which are not tripped, rest.

Fastened to the sidewall 1 are two parallel tracks 10 and 11. They guide a carriage 12. Four wheels 13 of the carriage engage the tracks 10 and 11.

A cam 14, projecting between two detention members or tines 9, is formed on the carriage 12. The cam 14 projects beyond the detention members as far as or a little further than the fingers 7. A deflection bevel 15 and a stop edge 16 are formed on the cam 14.

A lifting bar 17 is also movably mounted to the sidewall 1, on which a row of teeth 18 is formed. A stepping pawl 21, which pivots about a shaft 20, is mounted to an extension 19 of the carriage 12. The pawl 21 is preloaded against the carriage 12 by an extension spring 22. A rounded peak of the pawl 21 engages one of the teeth of the row of teeth 18. The lifting bar 17 is adjustably joined to a lifting member 24. For this purpose an elongated hole 25 running parallel to the lifting bar 17 is provided in the lifting member 24. Within the elongated hole 25 the lifting bar 17 has tapped holes 26, their mutual space matching the division width T. Screwed into one of the tapped holes 26 is a screw 27 which does not result in the rigid connection of the lifting bar 17 to the lifting member 24. Rather, the screw 27 interacts with the lower edge of the elongated hole 25 as step. Hinged to a pin 28 at the lower end of the lifting member 24 is an actuating lever 29 mounted to a shaft 30. The actuating lever 29 can be pivoted by means of a vending machine push button assigned to this trap door chute and not detailed.

Fastened to the stepping pawl 21 is a coupling lever 31 which runs alongside the sidewall 1 and has a handle 32 in front of th sidewall 1. Fastened to the carriage 12 is a leaf spring 33 which has a U-bend 34 and is supported by the handle 32. A reset bevel 35 which projects into the path of motion of the U-bend 34 in the tripped state of the door 3 is formed on each door 3 opposite the finger 7.

In FIGS. 1 and 2 the carriage 12 is shown in a central position in which some doors have already been tripped. Starting from this position, the operating mode of the described device is roughly as follows:

Upon pivoting the actuating lever 29 the lifting member 24 is raised. Since in the example shown the trap doors are arranged in the smallest possible division and, accordingly, the screw 27 sits in the appropriate tapped hole 26, an idle stroke between the lifting member 24 and the lifting bar 17 takes place first. Towards the end of the stroke of the lifting member 24, the lower edge of its elongated hole strikes the screw 27 so that thereafter the lifting bar 17 is moved upwardly. The rounded peak 23 sitting on a tooth 18 causes the stepping pawl 21 to move upwardly, taking along the carriage 12 via the shaft 20. In this process, the deflection bevel 15 of the cam 14 of the carriage 12, pivots the detention member 9 in outward direction (to the right in FIG. 1) so that the finger 7 drops off. The carriage 12 runs along the tracks 10 and 11 by means of its wheels 13. As soon as the carriage 12 has been raised far enough for its cam 14 to release the deflected detention member 9, the latter snaps under the stop edge 16 so that the carriage 12 can no longer escape a downward direction. The lifting bar 17 can then return down into its starting position. Due to the action of the spring 22 the stepping pawl 21 then engages the next higher tooth 18. These processes repeat until the uppermost door is tripped. The motions are smooth and easy because the carriage 12 does not jam and only a few parts need to be moved.

When refilling the chute, the carriage 12 must be returned to the bottom and the doors 3 returned to their horizontal storing position. All that is required for this is to push the handle 32 down. This causes the rounded peak 23 to disengage from the row of teeth 18 and the bevel 36 of the pawl 21 to deflect the detention members 9 and so, from under the stop edge 16, so that the carriage 12 can slide down. Simultaneous with the actuation of the handle 32, the U-bend 34 of the leaf spring 33 is being pushed against the reset bevels 35 in the course of the downward motion so that the doors assume their horizontal position again and their fingers 7 rest on the detention members 9. The offset in the height levels of the U-bend 34 and the bevel 36 assures that the carriage 12 can slide down easily, thereby resetting all doors 3. The resilient U-bend 34 effects a soft resetting motion.

As is evident, the design cost depends little on the number of doors 3 used because the carriage 12, the stepping pawl 21 and the rake forming the detention members 9 need be provided only once. The stroke length of the lifting bar 17 does not increase with the number of compartments. Rather, the stroke becomes shorter when many compartments are used.

The trap door chute is easy to convert for cases where the merchandise to be sold is higher than can be accommodated in the division width T. Then, only every other, third, or fourth door is left in the chute. The others are removed. To adjust the stroke length of the lifting bar 17, it may also be provided with a height-adjustable strip whose lower edge intersects with a stop of the sidewall 1 so that the starting point of the stroke is lower or higher, thereby lengthening or shortening the effective stroke of the lifting bar 17 upon the actuation of the actuating lever 29.

While a specific embodiment of the invention has been shown and described in detail to illustrate the application of the principles of the invention, it will be understood that the invention may be embodied otherwise without departing from such principles.

What is claimed is:

1. A trap door chute for a vending machine comprising:

a plurality of spaced doors pivotally hinged at one end to a chute wall of the machine, each door having a finger extending from an opposite end thereof;

a rake having a plurality of tines made of spring material each forming an elastic detention member in the machine for supporting each of said fingers, with their associated door in a storing position;

at least one vertical track in the machine extending substantially across a range of said spaced doors;

a carriage mounted for movement along said track;

a cam on said carriage for deflecting each detention member as said carriage moves along said track to release each supporting finger and allow each associated door to fall into a non-supported position;

a lifting bar extending substantially parallel to said track, vertically movably mounted in the machine, said lifting bar having a plurality of teeth with a spacing corresponding to a smallest spacing between said doors;

a pawl on said carriage engaged with one of said teeth to support said carriage in a position below which said cam deflects a next higher detention member; and a stop on said carriage for supporting said carriage on a detention member below said next higher detention member.

2. A trap door chute according to claim 1, including actuator means connected to said lifting bar for vertically moving said lifting bar by an adjustable stroke distance.

3. A trap door chute according to claim 2, wherein said actuator means include a lifting member having an elongated hole therein connected to said lifting bar at a screw connection, said lifting member movable on said lifting bar by a distance limited by a movement of said screw connection in said elongated hole.

4. A trap door chute according to claim 2, wherein said actuator means includes a height adjustable strip connected to said lifting bar having a lower edge engageable with a sidewall stop to start a stroke of movement of said lifting bar.

5. A trap door chute according to claim 1, wherein each door includes a reset bevel extending adjacent said one end of each door, said carriage including a reset member movable in a path with movement of said carriage along said track, each reset bevel extending into said path with its associated door in its non-supported position, each door movable into its supported position by engagement of said reset member with movement of said carriage with each respective reset bevel, said carriage including a coupling lever movable to disengage said pawl from a tooth on said lifting bar and for moving said reset member into said path to engage each reset bevel.

6. A trap door chute according to claim 5, wherein said coupling lever includes a bevel portion which upon movement of said coupling lever, moves into a path occupied by said detention members for deflection of a next lower detention member with movement of said carriage.

7. A trap door chute according to claim 6, wherein said bevel portion is located below said reset member and said cam and said carriage stop are positioned between said bevel member and said reset member.

8. A trap door chute according to claim 5, wherein said coupling lever carries said bevel portion and said pawl.

9. A trap door chute according to claim 5, wherein said reset member comprises a leaf spring having a U-bend portion.

10. A trap door chute according to claim 1, including one additional track, said carriage including four wheels rotatably mounted thereon at spaced locations, two of said wheels engaged with said first mentioned track and a remaining two of said wheels engaged with said additional track.

11. A trap door chute according to claim 1, wherein said pawl is pivotally mounted on a shaft connected to said carriage.

12. A trap door chute according to claim 1, wherein said rake with a plurality of tines consists of spring steel.

13. A trap door chute for a vending machine comprising:

a plurality of spaced doors pivotally hinged at one end to a chute wall of the machine, each door having a finger extending from an opposite end thereof;

a rake having a plurality of tines made of spring material each forming an elastic detention member in the machine for supporting each of said fingers, with their associated door in a storing position;

at least one vertical track in the machine extending substantially across a range of said spaced doors;

a carriage mounted for movement along said track;

a cam on said carriage for deflecting each detention member as said carriage moves along said track to release each supporting finger and allow each associated door to fall into a non-supported position;

a lifting bar extending substantially parallel to said track, vertically movably mounted in the machine, said lifting bar having a plurality of teeth with a spacing corresponding to a smallest spacing between said doors;

a pawl on said carriage engaged with one of said teeth to support said carriage in a position below which said cam deflects a next higher detention member;

a stop on said carriage for supporting said carriage on a detention member below said next higher detention member; and actuator means connected to said lifting bar for vertically moving said lifting bar by an adjustable stroke distance, said actuator means including a lifting member having an elongated hole therein connected to said lifting bar at a screw connection, said lifting member movable on said lifting bar by a distance limited by a movement of said connection in said elongated hole.

14. A trap door chute for a vending machine comprising:

a plurality of spaced doors pivotally hinged at one end to a chute wall of the machine, each door having a finger extending from an opposite end thereof;

a rake having a plurality of tines made of spring material each forming an elastic detention member in the machine for supporting each of said fingers, with their associated door in a storing position;

at least one vertical track in the machine extending substantially across a range of said spaced doors;

a carriage mounted for movement along said track;

a cam on said carriage for deflecting each detention member as said carriage moves along said track to release each supporting finger and allow each associated door to fall into a non-supported position;

a lifting bar extending substantially parallel to said track, vertically movably mounted in the machine, said lifting bar having a plurality of teeth with a spacing corresponding to a smallest spacing between said doors;

a pawl on said carriage engaged with one of said teeth to support said carriage in a position below which said cam deflects a next higher detention member; and a stop on said carriage for supporting said carriage on a detention member below said next higher detention member;

each door including a reset bevel extending adjacent said one end of each door, said carriage including a reset member movable in a path with movement of carriage along said track, each reset bevel extending into said path with its associated door in its non-supprted postion, each door movable into its supported position by engagement of said reset member with movement of said carriage with each respective reset bevel, said carriage including a coupling lever movable to disengage said pawl from a tooth on said lifting bar and for moving said reset member into said path to engage each reset bevel.

* * * * *